United States Patent [19]

Wilson

[11] 4,100,616

[45] Jul. 11, 1978

[54] DOCKING STATION

[76] Inventor: William Wilson, 716 Scott St., Stroudsburg, Pa. 18360

[21] Appl. No.: 762,786

[22] Filed: Jan. 25, 1977

Related U.S. Application Data

[63] Continuation-in-part of Ser. No. 608,945, Aug. 29, 1975, which is a continuation-in-part of Ser. No. 321,436, Jan. 5, 1973, abandoned.

[51] Int. Cl.[2] ..... B01F 9/04; B66C 1/66

[52] U.S. Cl. ..... 366/213; 366/236; 214/312; 248/130; 366/232

[58] Field of Search ..... 259/72, 81 R, 89, 90, 259/57, 58, 3, 14, 30; 214/312, 313, 314, 315, 620, 621; 248/130, 131, 132, 133, 139–143

[56] References Cited

U.S. PATENT DOCUMENTS

| | | | |
|---|---|---|---|
| 2,513,352 | 7/1950 | O'Meara | 259/81 R |
| 2,971,662 | 2/1961 | Dunham | 214/313 |
| 3,174,728 | 3/1965 | Mack | 248/130 |
| 3,224,741 | 12/1965 | Muench | 259/81 R |
| 3,421,053 | 1/1969 | Rinard | 259/72 |

*Primary Examiner*—Robert W. Jenkins
*Attorney, Agent, or Firm*—Stuart E. Beck

[57] ABSTRACT

A docking station for rotating a container to mix the materials therein. The docking station includes fluid actuated cylinders which are operative to retain the container thereon during rotation. The cylinders are actuated by a mechanism which is energized when the container is received on the docking station. Additionally, means supporting containers with round sides so that they can be rotated by the docking station is disclosed.

24 Claims, 11 Drawing Figures

DOCKING STATION

This patent application is a continuation-in-part patent application of patent application Ser. No. 608,945, filed Aug. 29, 1975 which was a continuation-in-part of patent application Ser. No. 321,436 filed Jan. 5, 1973 and which is now abandoned.

This invention relates to a docking station and more particularly to a docking station which can automatically retain a container which is moved into position to be rotated thereby.

It has been recognized that there are important advantages which can be achieved in connection with the transportation and mixing of many materials if they can be mixed in the same containers in which they are transported. Mixing is often necessary because in the course of shipment the constituent materials may separate and/or compact. Additionally, additives may be introduced to the container and the combined ingredients must be mixed. If the materials are toxic or if they are fine powders they can present serious health hazards when exposed or transferred.

Thus, a material handling system has been developed which compirses a container which is designed to be received on a particular docking station, as shown in the above mentioned patent applications so that the materials can be treated in the same containers in which they are shipped.

However, those systems are not entirely satisfactory since they do not have a convenient and automatic way to secure a container on the docking station. Typically, with prior systems the container is delivered to the docking station on a fork lift truck. The truck driver must first position the container on the docking station and then dismount to operate container to docking arms.

Still further in prior art systems, the docking arms can only accept containers of a particular shape and size. Thus, processors must maintain an inventory of docking stations so as to accommodate a wide variety of containers of different sizes and shapes.

Further, while the arms of the docking station were straight and disposed at an angle with respect to each other, often it was necessary to mix materials in cylindrical containers which cound not be supported on the straight docking arms. Typically, such containers are the well known fiber board drums having a capacity of about 35 to 55 gallons, such cylindrical containers could not be supported on the straight arms of the docking station. Thus, many different techniques were employed in order to modify the arms or the container shape so that the container could be accommodated in the arms. However, they were not satisfactory because they were difficult to install on a container and because they were of low reliability in that the container often slipped or its side walls were damaged.

With the foregoing in mind the invention relates generally to a docking station for supporting and rotating a container which comprises a first member and two arms which are coupled to the first member for rotation. The arms are angularly disposed with respect to each other to define a zone in which the container that is to be supported by the arms will be received. Locking means are mounted on each of the arms for selective movement into and out of locking engagement with the container to selectively retain it on the arms. Means are coupled to the locking means for causing the selective movement, and means are provided for rotating the arms.

Further, the invention relates to a device for supporting a cylindrical container on a docking station having two angularly disposed arms. The device comprises two angularly disposed members which are coupled to each other at an angle which is the same as the angle of the arms on the docking station so that it can be supported thereby. Interlocking means which extend along the angularly disposed members are engageable with complementary interlocking means on the arms. Further, means are provided for engaging a cylindrical surface. Finally, means are provided for retaining the engaging means on the surface.

For the purpose of illustrating the invention, there is shown in the drawings forms which are presently preferred; it being understood, however, that this invention is not limited to the precise arrangements and instrumentalities shown.

Figure 1:
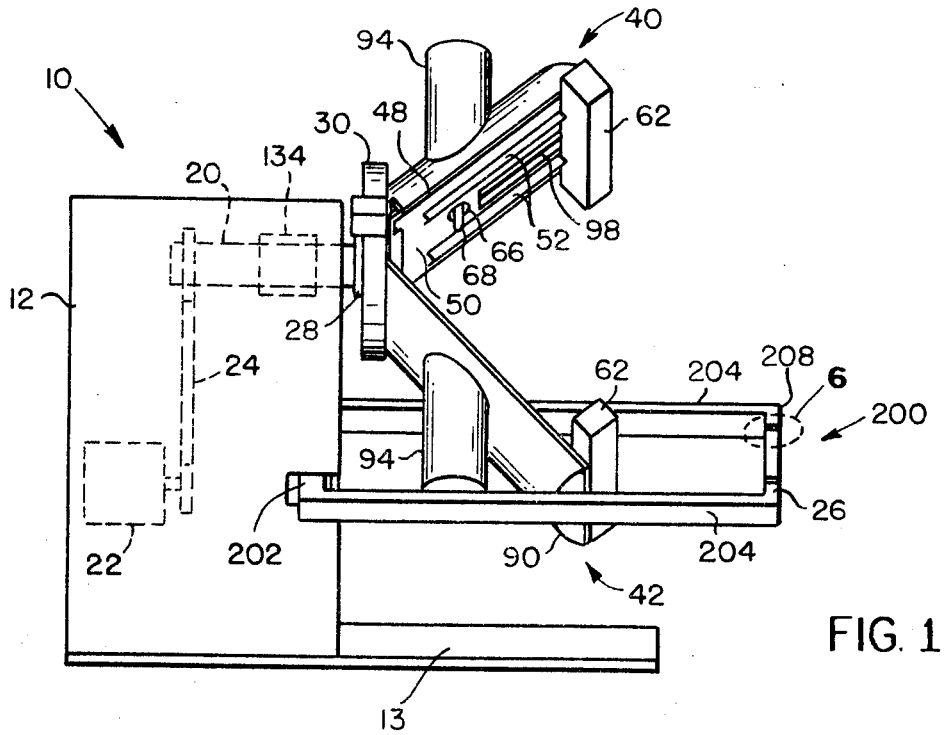
FIG. 1 is a side view of a docking station constructed in accordance with this invention and viewed from an angle slightly above the horizontal.

Referring now to the drawing for a detailed description of the invention, FIG. 1 illustrates a docking station 10 which includes a housing 12 which may be supported on base 13.

Figure 8:
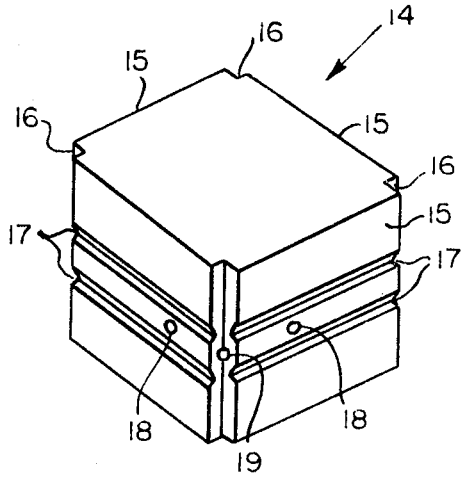
FIG. 8 is a perspective view of a container that may be used with the docking station.

The docking station may preferably be used with container of the type disclosed in the above mentioned patent applications. Such a container 14 is seen in FIG. 8. It includes a plurality of sides 15 which are connected to each other by "V" shaped brackets 16 so that each corner of the container includes an inwardly directed recess. Preferably, the brackets are "L" shaped. The corner construction provides added stiffness for the container. It also has another advantage that will be described herein.

At least two adjoining sides 15 of the container 14 may be provided with at least one or more transversally extending recesses 17. The recesses may comprise "V" shaped notches which serve to increase the rigidity of sides 15 as well as cooperate with complementary members on the docking station 10. One of the brackets 16 may include an aperture 19 to receive the drive shaft for mixing in the container.

The adjacent sides of the container also includes apertures 18 into which locking pins can extend in order to hold the container on the docking station.

Extending outwardly from the housing near its upper end is a shaft 20 which is supported in the housing by bearings (not shown). The shaft may be connected to the motor 22 by a drive chain 24.

The driving components of the docking station may be contained within a suitable protected covering such as that illustrated in order to reduce the likelihood of harm to persons tending the machine.

Figure 2:
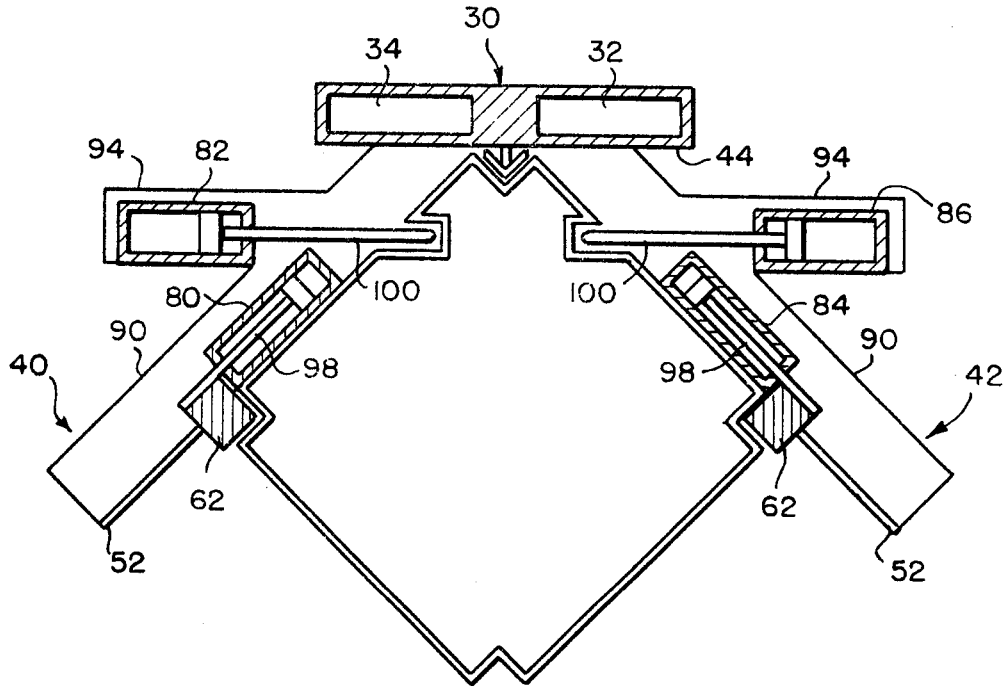
FIG. 2 is a top plan view of the docking station illustrated in FIG. 1, partially in section, and with a container supported thereby.

A radially directed flange 28 is secured to the exposed end of the drive shaft. A housing 30 which may include two chambers 32 and 34 (FIGS. 2 and 5) is secured to flange 28. The purpose of these chambers will be explained herein.

The docking station 10 includes two elongated arms 40 and 42 which are connected to one end to the front face 44 of the housing 30. Since the two arms are identical in construction and in function, the same reference numerals will be used to identify the same part on each arm; it being understood that an explanation of one of the arms is also an explanation of the other arm.

Thus, each of the arms 40, 42 comprises a rigid elongated member 48 having an inwardly facing surface 50 on which are located two longitudinally extending and inwardly directed ribs 52 which may be engaged in the recesses 17 which extend along the side walls of a container which is to be supported by the arms, all as explained in full detail in the parent patent applications. While two ribs are illustrated, it is apparent that in certain circumstances, depending on the size and weight of the container to be supported, more or less could be used.

Thus, it should be appreciated that in order to maximize the efficiency the docking station, it should be used with containers that are light weight so that more material can be mixed. Thus, having grooves on the side walls of the containers into which the ribs can project will substantially increase the rigidity of the side walls of thin walled, light weight containers so that as they are rotated, their shape will be maintained.

Additionally, each of the arms includes an elongated centrally disposed slot 60 which functions as a guideway for the clamping blocks 62 as will be explained in greater detail herein.

Further, at the end of the arm adjacent the front face of flange 28 is an aperture 66 through which an elongated locking pin 68 extends.

The clamping block 62 and pin 66 are mounted for movement along and through arms 40 and 42 by actuating members which are supported on the arms. There are four actuating members, two on each arm. One is coupled to pin 68 while the other is coupled to clamping block 62.

The actuating members may be any devices that are capable of selective movement along a predetermined path. Thus, they could be fluid cylinders such as pneumatic cylinders 80, 82, 84 and 86 which are seen best in FIG. 2.

Cylinders 80 and 84 are supported on the outer face of arms 40 and 42 and may be hidden by sleeves 90.

Figure 3:
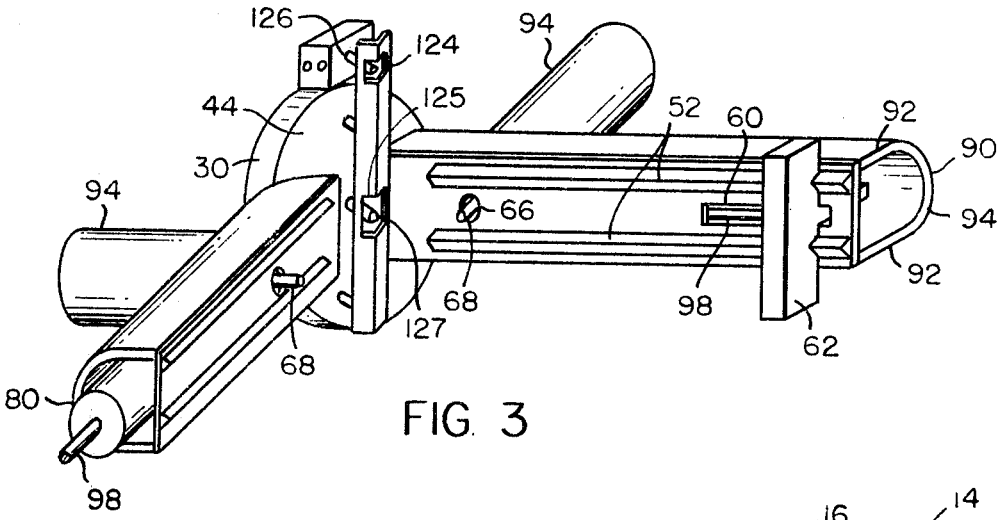
FIG. 3 is a front perspective view of a detail of the docking station in FIG. 1.

As best seen in FIGS. 1 and 3 sleeve 90 comprises a generally U-shaped member having side walls 92 which are connected by a bridging member 94. The sleeve design is useful since, in addition to providing a housing in which the actuating means for clamping block 62 can be located, it also promotes an increased rigidity of the arm to thereby minimize the likelihood of benging when it rotates a heavy container.

The piston rods 98 of cylinders 80 and 84 extend through the sleeves 90. A clamping block 62 is connected to the end of each piston rod 98 and extends upwardly through slot 60.

Cylinders 82 and 86 and their respective piston rods 100 are supported at an angle with respect to arms 40 and 42 so that the piston rods can extend through the apertures 66. The cylinders are hidden by sleeves 94.

It is apparent that the ends of the piston rods 100 comprise the aforementioned locking pins 68. The pins are receivable in apertures 18, in the side walls 16 of the containers 14 that will be rotated by the docking station.

Figure 4:
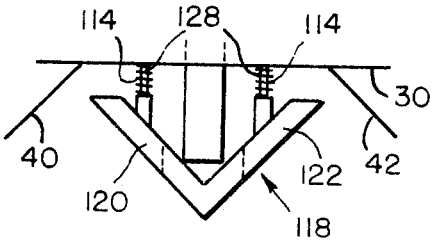
FIG. 4 is a plan view of a portion of FIG. 3.

As best seen in FIGS. 3 and 4, the front face of housing 30 includes a plurality of forwardly extending guide pins 114 which are slidably received in sleeves 116 on the rear wall of shield 118. The shield is disposed in the space between the juncture of the arms 40 and 42.

The shield includes upper and lower apertures 124 and 125. Switch operator 126 is disposed behind the shield but in alignment with aperture 124. A drive shaft 127 which is engageable with a mixing bar in a container 14 is disposed behind aperture 125. Thus, the shield protects the switch operator and drive shaft 127 from being inadvertently damaged.

It includes two walls 120 and 122 which are at a convenient angle with respect to each other. Thus, the shield could compirse an "L" bracket or any other suitable angle. It includes a centrally positioned aperture 124 through which a depressable switch operator 126 can extend.

The shield is normally urged by suitable springs 128 away from face 44 so that the switch operator 126 cannot be inadvertently depressed.

Figure 5A:
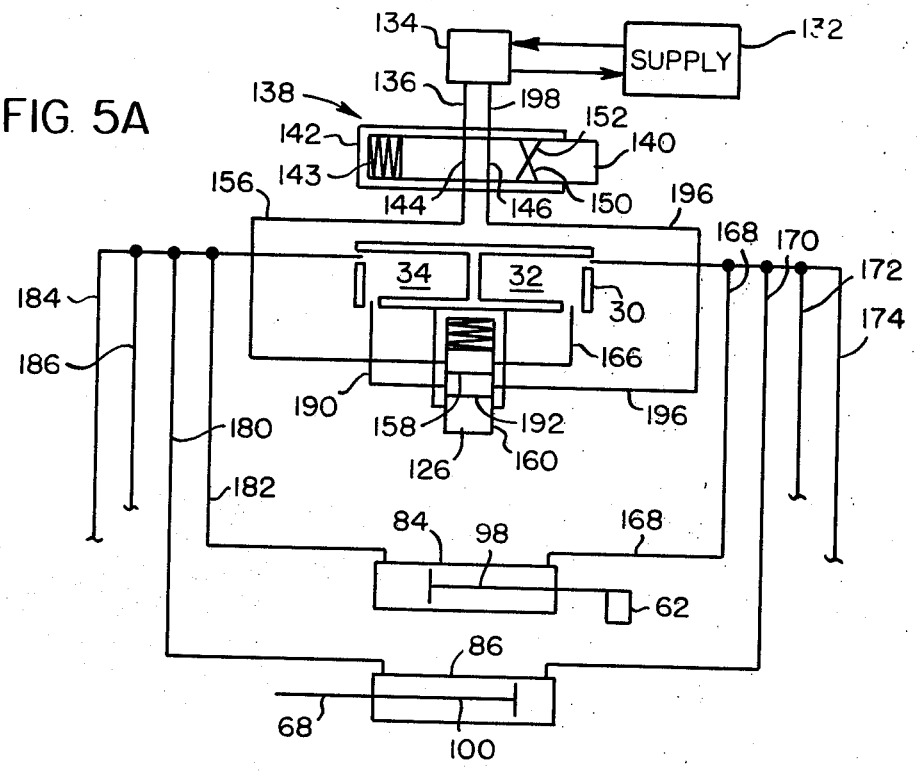
FIGS. 5A and 5B are schematic representations of the pneumatic locking system for the docking station.
Figure 5B:
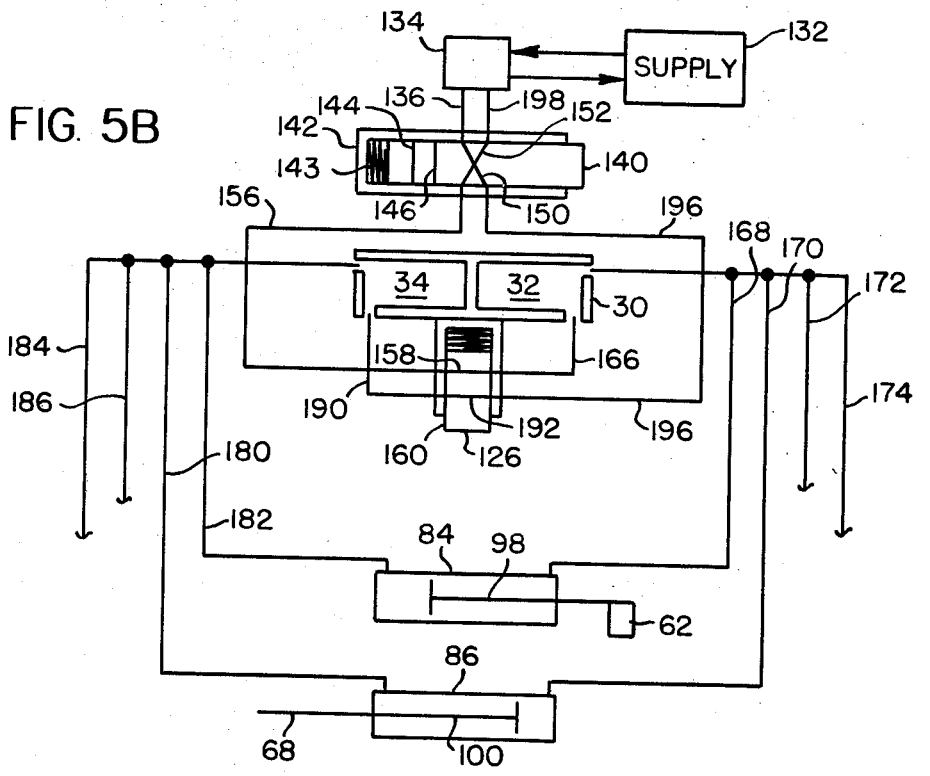

The cylinders and switch operator are part of a fluid system that is shown in FIGS. 5A and 5B. The system includes a source of supply 132 which could be an air compressor or a fluid pump. The supply is connected by a rotary union 134 which is on shaft 20 to conduit 136. The rotary union is a well known type of device which is used to make a fluid coupling between a fixed and rotating fluid conduit. Thus, conduit 136 is part of the rotating system of the docking station.

A release switch 138 is provided. It includes an operator 140 which is mounted for axial movement in a housing 142. The operator includes parallel passages 144 and 146 and cross passages 150 and 152. The switch 138 may be mounted on the rear face of housing 30 or on any other element on the rotating part of the docking station.

Normally, operator 140 is spring biased to the position shown in FIG. 5A. This, passage 144 is connected by way of conduit 156 to passage 158 in the housing 160 of switch 162. The switch operator 126 is spring biased to the position shown in FIG. 5A so that passage 158 is normally closed.

On the other side of the operator 126 passage 158 is connected by way of conduit 166 to the inlet port of chamber 32. The chamber has a plurality of outlets with conduits 168, 170, 172 and 174 connected at one end to them.

The other end of each conduit is connected to one side of the piston cylinders 80, 82, 84 and 86 respectively. For the purpose of explanation only cylinders 84 and 86 are shown since a description of their operation will serve also as a description of the other cylinders.

The other side of cylinders 80, 82, 84 and 86 are connected by conduits 180, 182, 184 and 186. A plurality of inlet ports to chamber 34. The outlet port of that chamber is connected by way of conduit 190 to normally closed passage 192 in switch 162. Passage 192 is connected by way of conduit 196 to passage 146 in switch 138 which is in turn connected by conduit 198 to the rotary union and then back to the supply.

Switch 162 is disposed in housing 130 with its operator 126 extending into a container receiving zone which is defined between arms 40 and 42. When a container is not supported on arms 40 and 42 operator 126 is hidden by shield 118. When operator 126 is despressed the cylinders are actuated to lock a container on the docking station.

The shield 118 and bracket 16 have the same angular configuration so that the bracket will nest with the shield. Also arms 40 and 42 are spaced from each other a suitable distance to prevent the shield from being depressed by the bracket 16 until the ribs 52 are received in the recesses 17 on the sides of the container.

A container 14 may be mounted on the docking station by first positioning it so that the recesses 17 on its side walls are in alignment with ribs 52. Then, the container is moved toward the housing 30 until one of the angle brackets 16 nests with the shield 118 and pushes it back against the force of springs 128 to expose and depress operator 126 on switch 162.

As seen in FIG. 5A, this completes a circuit which will cause the locking pins 68 and clamping blocks 62 to move toward the container and lock it on the docking station. The circuit includes conduit 136, passage 144, conduit 156, passage 158, conduit 166, chamber 32, and then through conduits 168, 170, 172 and 174 to cylinders 82, 84, 86 and 88. As the cylinder chambers fill, the piston rods 98 and 100 will be displaced causing the clamping blocks 62 and locking pins 68 to engage the container.

Thus because the clamping blocks 62 are "T" shaped they extend a substantial distance along the brackets 16 in the container. Further, the shield, because it is relatively long also extends a substantial distance along the bracket 167 that it nests with. Thus, the two clamping blocks and shield support the container as it rotates thereby relieving the load that the ribs would have to support.

The fluid on the other side of the pistons in each cylinder is returned to the supply by a curcuit that includes conduits 180, 182, 184 and 186 which connect the cylinders to chamber 34. Then from chamber 34, through conduit 190, passage 192, conduit 196, passage 146 in release valve 138 and conduit 198 to the rotary union 134.

The container is released from the docking station by depressing operator 140 to the piston shown in FIG. 5B. This causes the clamping blocks 62 and locking pins 68 to move away from the container through a circuit that includes conduit 136, passage 150, conduit 196 passage 192 (operator 126 is still depressed by the container) conduit 190, chamber 34, and then by way of conduits 180, 182, 184 and 186 to cylinders 80, 82, 84 and 86 to displace their piston rods toward the other ends of the cylinders.

The fluid discharged from the cylinders will flow by way of conduits 168, 170, 172 and 174 into chamber 32. Then it will pass through conduit 166, passage 158, conduit 156 and passage 152 to the rotary union.

While the automatic operation of the docking station has been described in connection with a four sided container with a recess in each of its four corners, such an arrangement is not necessary in order to achieve this advantage of the invention. Thus, the same advantages can be realized in a container with any number of sides as long as there is a recess in one corner that can nest with the shield to depress it and operator 126.

Further, if it may be desired to operate the docking station, by using only the locking pins 68, or only the clamping blocks 62 if the container to be rotated is not a container having the recesses 17 and apertures 18 that are on container 14. This could be readily accomplished by merely closing the conduits to those cylinders which are not to be actuated. Additionally, it should be noted that since the fluid flow system is self-balancing all of the locking pins and clamping blocks will move outwardly to the limit of their travel to unlock the container as long as there is pressure in the system. Also, they will move inwardly to lock the container on the docking station as long as there is pressure in the system. Thus, if an unsymmetric container such as a rectangular container were to be mounted on the docking station one of the clamping blocks would engage the container before the other. The movement of this clamping block would then be halted and the other clamping block would continue on its path of travel until it engaged the container. Then, both clamping blocks would apply equal pressure to the container.

In certain circumstances it may be desirable to have the clamping blocks 62 engage the container before the locking pins and be released from the container after the pins are released.

This can be accomplished in a variety of ways. However, in the presently preferred form of the invention it is accomplished by providing springs of different strength inside the cylinders. Thus a heavy spring in cylinders 82 and 86 that is positioned so that it is compressed when the locking pins move to lock the container will cause the clamping blocks to engage the container first during locking and release it after the locking pins.

Figure 6:
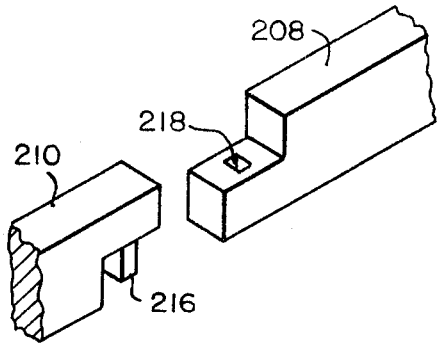
FIG. 6 is a perspective view of a portion of FIG. 1.
Figure 7:
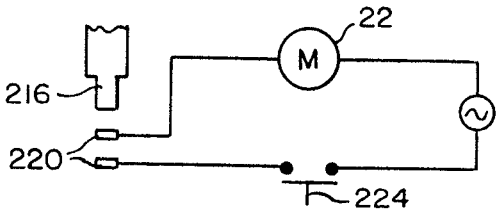
FIG. 7 is a schematic representation of the electrical circuit for the docking station.

FIGS. 1, 6 and 7 show a safety interlock means which is operative to halt rotation of the docking station when someone enters its immediate area. In a presently preferred form of the invention the safety interlock comprises a rail 200 which is supported by the docking station and has portions 202 which extend laterally of the docking station and portions 204 extend forwardly thereof. The distal end of portions 204 support inwardly turned end portions 206 and 208 which support a gate 210 therebetween.

The gate may be pivotally connected to end portions 206 in a conventional manner. End portion 208 may have an end construction such as that illustrated in FIG. 6 wherein plunger 216 is receivable in aperture 218 therein. As can be seen in FIG. 6 when the gate is closed plunger 216 closes contacts 220 to enable a circuit through motor 22. Then, when the control switch 224 is closed, the motor can operate to rotate the container.

If the gate 210 is raised while the container is rotating, contacts 220 will be opened and the motor will be deenergized.

It should be appreciated that there are many ways of providing a safe zone around the docking station while it is rotating a container. Thus, the gate could be replaced by optical systems, pressure sensitive systems, or other devices which are well known and which are capable of generating a signal when a predetermined space is violated.

Figure 9:
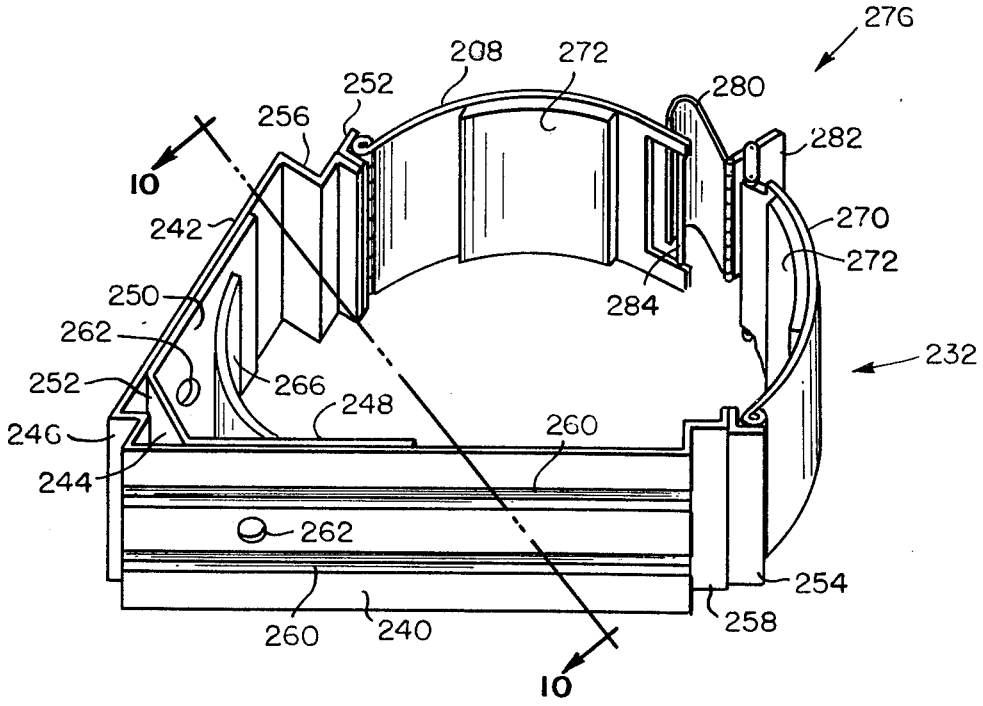
FIG. 9 is a perspective view of an adapter for supporting a cylindrical container on the docking station.
Figure 10:
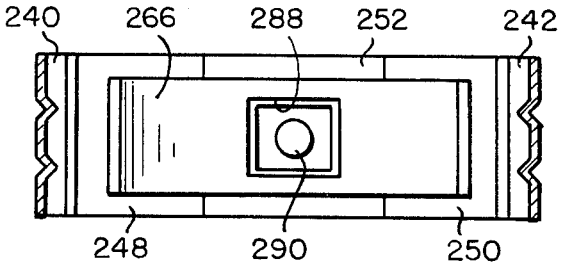
FIG. 10 is a section view taken along line 10—10 of FIG. 9.

Referring now to FIGS. 9 and 10 a drum saddle 232 for engaging a cylindrical container such as a fiber board drum and supporting it on the docking station arms is illustrated. The device includes two elongated members 240 and 242 which define the sides of the device. They are connected to each other and to a bracket 244.

The juncture of members 240 and 242 defines a recess 246 which may be identical to the recess defined by the bracket 16 in container 14 and which will nest with shield 118 as well as provide increased strength. Bracket 244 includes legs 248 and 250 which are angularly disposed with respect to each other and which are interconnected by a web 252.

Each of the legs 248 and 250 are connected to one of the members 240 and 242 to retain them at an angular relation which is the same as the angle at which the arms of the docking station are arrnaged so that the device 232 can be received therein.

The distal ends of the members 240 and 242 are coupled to brackets 252 and 254 by suitable means such as rivets, welding, or the like. The ends are also folded to form recesses 256 and 258 that are similar to recess 246.

Each of members 240 and 242 include at least one or more recesses 260 that extend their length. The recesses may be "V" shaped notches which increase the rigidity of the device as well as cooperate with the ribs 52 on arms 40 and 42.

Also, a hole 262 for receiving the locking pins 68 is located in each of members 240 and 242.

A web 266 of flexible frictional material such as belting which is mounted on rubber impregnated fabric is supported between the inner walls of the members 240 and 242. The web is adapted to lie along a portion of the circumference of cylindrical member.

The brackets 252 and 254 are each hinged to second and third webs 268 and 270. The webs may be made of the same frictional material as web 266 or they may include pads 272 of frictional material mounted on their inner surfaces.

The webs 268 and 270 may be connected to each other by a suitable latching means so that the webs will completely surround and lie close against the side walls of a cylindrical container without slipping and without damaging it.

Preferably, a simple locking means such as the over-the-center clamp 276 illustrated in FIG. 9 is used. This clamp comprises a hook 280 which is pivotally connected to a toggle arm 282. Toggle arm 280 is also pivotally connected to web 270, however, its connection to the hook is spaced from its connection to web 282. The hook is engaged over bar 284 that extends from web 268 then toggle arm 282 is rotated so that it lies over the hook 280. Because the pivotal connection between hook 280 and web 270 is spaced from the pivotal connection between the toggel and the hook the hook will be displaced and draw webs 268 and 270 together and the webs will hold the device tightly on the container.

The container can then be moved about in a convenient fashion. When it is moved to the docking station recess 246 will engage the shield 118 and displace it in a manner identical to that described above with respect to the rectangular containers. Then, the clamping blocks will slide down and engage the ends of members 240 and 242 while the locking pins will engage the device through holes 262.

Referring to FIG. 9, it may be desirable to connect a docking station drive shaft to a cylindrical container having a mixing bar and which is mounted in device 232. This can readily be acccomplished by modifying the device as illustrated in FIG. 10 where an aperture 288 has been formed through web 252, the recess 246 and the web 266. The end face of the drive shaft 290 can be seen in this aperture. Thus, when a cylindrical container of the type having a mixing bar is mounted on the device the drive shaft can extend through aperture 288 to engage the mixing bar.

While the invention has been described wih respect to certain forms and embodiments thereof, it is apparent that many other forms and embodiments of the invention will be obvious to those skilled in the art in view of the foregoing description. Thus, the scope of the invention should not be limited by the specification and drawings, but rather only by the scope of the claims appended hereto.

What is claimed is:

1. A docking station for supporting and rotating a container comprising a first member, two arms, said arms being coupled to said first member for rotation with said first member and being angularly disposed with respect to each other to define a zone in which a container that is to be supported by said arms will be received, locking means mounted on each of said arms for selective movement into and out of locking engagement with a container to selectively retain it on said arms, means for causing said selective movement coupled to said locking means, and means for rotating said first member.

2. A device as defined in claim 1 including each of said arms having one end connected to said first member and extending outwardly therefrom, actuable means mounted on at least one of said arms for rotation therewith, means for coupling said actuable means to said locking means so that actuation of said actuable means causes said selective movement of said locking means, and means for selectively actuating said actuable means.

3. A device as defined in claim 2 wherein said means for selectively actuating said actuable means includes a switch, and at least a portion of said switch extends into said zone to be engaged by a container in said zone.

4. A device as defined in claim 3 including a shield, means for yieldably supporting said shield in said zone in shielding relation to said switch so that said switch is normally shielded and so that a container can cause said shield to be moved from its shielding relation and said switch to be engaged.

5. A docking station as defined in claim 1 including means defining a safety zone around said docking station, said safety zone means including a switch that is coupled to said means for rotating said arms, and said switch is operative to stop rotation of said arms when said safety zone is penetrated.

6. A device as defined in claim 5 wherein said safety zone is defined by a rail surrounding said docking station, a gate in said rail for permitting access to said docking station, and rotation is stopped when said gate is opened.

7. A docking station for supporting and rotating a container comprising two arms that are disposed at an angle with respect to each other to define a zone in which a container that is to be supported by said arms will be recieived, actuable means mounted on at least one of said arms, means for locking a container on said arms, said locking means cooperating with said actuable means and including a container detecting element, at least a portion of said element being disposed between said arms to detect a container in said zone, a shield,and resilient yieldable means yieldably supporting said shield over said detector.

8. A device as defined in claim 7 wherein said arms include means defining guide ways, said guide ways extending lengthwise on said arms, and said locking means are constrained by said guide ways for movement lengthwise along said arms.

9. A device as defined in claim 7 including a hole in at least one of said arms and said locking means includes an elongated member which is extendable through said hole and into said zone when said actuable means is actuated to engage and retain a container on said docking station.

10. A device as defined in claim 7 including a hole in at least one of said arms and means defining a guide way extending lengthwise on said arm, and said locking means includes an elongated member which is moveable through said hole and a clamping member which is moveable along said guide way, and said elongated member and said clamping member are coupled to said actuating means and are moved relative to the container when said actuating means is actuated.

11. A device as defined in claim 10 wherein said actuable means includes means for causing said elongated members to engage said container after said clamping members engage said container, and means for causing said elongated members to release said container after said clamping members release said container.

12. A device as defined in claim 7 wherein said actuable means include a plurality of fluid actuable cylinders.

13. A device as defined in claim 7 wherein said actuable means include a plurality of pneumatic cylinders.

14. A docking station for a container of the type that has a plurality of sides and top and bottom walls and the juncture of at least two of said sides defines a recess for at least a portion of the length of said juncture comprising two arms mounted on said docking station for rotation, said arms being disposed in the same angular relation with respect to each other as the angular relation of said two sides so that said arms can support said container, actuable locking means for retaining said container on said docking station, a switch supported on said docking station between said arms, said switch being coupled to said actuable locking means, a shield, said shield comprising a projecting member having a shape that is complementary to said recess, means for yieldably supporting said shield over said switch, and said container is operative to move said shield and actuate said locking means when container is moved into engagement with said arms.

15. A device as defined in claim 14 wherein said recess and said shield are both "V" shaped.

16. A device as defined in claim 14 including a shaft, means for rotating said shaft, a plate supported on one end of said shaft, said arms being supported on said plate, said switch being disposed between said arms a plurality of guide members mounted on said plate, and extending outwardly therefrom, said shield being slidably mounted on said guide members for movement toward and away from said plate, and yieldable means for urging said shield away from said plate.

17. A device as defined in claim 16 wherein said recess and said shield are both "V" shaped.

18. A device as defined in claim 16 wherein said recess and said shield are both "L" shaped.

19. A device for supporting a cylindrical container on a docking station having two angularly disposed arms comprising, two angularly disposed members, means for coupling said members to each other at an angle which is the same as the angle of said arms so that said device can be supported thereby, interlocking means extending along said angularly disposed members which are engageable with complementary interlocking means on said arms, means coupled to said members for engaging a cylindrical surface, and means for retaining said engaging means on said surface.

20. A device as defined in claim 19 wherein said cylindrical surface engaging means includes a first elongated curved member coupled to the inner surfaces of said angularly disposed members and extending over the juncture of said last named members, and a second curved member connected between the ends of said angularly disposed members so that said first and second curved members surround and engage said cylindrical container.

21. A device as defined in claim 20 wherein said second curved member comprises two portions, one end of each of said portions being connected to the distal end of each of said angularly disposed arms, and means for connecting the other ends to each other.

22. A device as defined in claim 19 wherein said means for coupling said members to each other includes a longitudinally extending recess on the side of said means which is opposed to that on which said container is engaged.

23. A device as defined in claim 22 wherein said recess is "V" shaped.

24. A device as defined in claim 22 including an aperture in said means for coupling said members to each other through which a bar can be extended.

* * * * *